US006807950B2

(12) United States Patent
Boss et al.

(10) Patent No.: US 6,807,950 B2
(45) Date of Patent: Oct. 26, 2004

(54) FUEL INJECTION DEVICE FOR INTERNAL COMBUSTION ENGINE

(75) Inventors: Juergen Boss, Kornwestheim (DE); Johannes-Joerg Rueger, Vienna (AT); Klaus Zimmerman, Vienna (AT)

(73) Assignee: Robert Bosch GmbH (DE)

( * ) Notice: Subject to any disclaimer, the term of this patent is extended or adjusted under 35 U.S.C. 154(b) by 0 days.

(21) Appl. No.: 10/432,374

(22) PCT Filed: Jul. 13, 2002

(86) PCT No.: PCT/DE02/02574

§ 371 (c)(1),
(2), (4) Date: Nov. 19, 2003

(87) PCT Pub. No.: WO03/027468

PCT Pub. Date: Apr. 3, 2003

(65) Prior Publication Data

US 2004/0065301 A1 Apr. 8, 2004

(30) Foreign Application Priority Data

Sep. 22, 2001 (DE) ..... 101 46 747

(51) Int. Cl.[7] ..... F02M 37/04
(52) U.S. Cl. ..... 123/506; 123/494
(58) Field of Search ..... 123/458, 494, 123/506, 500, 501, 357; 73/119 A; 251/129.06

(56) References Cited

U.S. PATENT DOCUMENTS

| | | | | | |
|---|---|---|---|---|---|
| 4,176,822 | A | * | 12/1979 | Chadwick | 251/129.06 |
| 4,643,155 | A | * | 2/1987 | O'Neill | 123/506 |
| 4,838,233 | A | * | 6/1989 | Hayashi et al. | 123/506 |
| 4,958,610 | A | * | 9/1990 | Yamamoto et al. | 123/478 |
| 5,109,885 | A | * | 5/1992 | Tauscher | 137/554 |
| 5,533,477 | A | * | 7/1996 | Weigl | 123/494 |
| 6,253,736 | B1 | * | 7/2001 | Crofts et al. | 123/498 |
| 6,367,453 | B1 | * | 4/2002 | Igashira et al. | 123/467 |
| 6,732,948 | B1 | * | 5/2004 | Buckley | 239/102.2 |

* cited by examiner

*Primary Examiner*—Carl S. Miller
(74) *Attorney, Agent, or Firm*—Ronald E. Greigg

(57) ABSTRACT

A fuel injection system having a fuel injection valve in which an injection valve member is urged in an opening direction counter to a closing force by pressure in a pressure chamber which generated by a high-pressure fuel pump driven by a cam. A control valve is actuated by a piezoelectric actuator triggered by an electric control unit by which a communication of the pressure chamber with a relief chamber is controlled. When the control valve is closed, the pressure chamber is disconnected from the relief chamber. The control valve has a control valve member coupled with the actuator via a hydraulic coupler. The actuator, after a charging phase, communicates with an associated voltage meter, and the voltage between the electrical terminals of the actuator is monitored for detecting the function of the control valve.

20 Claims, 2 Drawing Sheets

FUEL INJECTION DEVICE FOR INTERNAL COMBUSTION ENGINE

CROSS-REFERENCE TO RELATED APPLICATIONS

This application is a 35 USC 371 application of PCT/DE 02/02574 filed on Jul. 13, 2002.

BACKGROUND OF THE INVENTION

1. Field of the Invention

The invention is directed to an improved fuel injection system for an internal combustion engine.

2. Description of the Prior Art

One fuel injection system, known from German Patent Disclosure DE 198 35 494, has a fuel injection valve, with an injection valve member by which at least one injection opening is controlled. The injection valve member is urged in an opening direction counter to a closing force by the pressure prevailing in a pressure chamber of the fuel injection valve. The pressure prevailing in the pressure chamber is generated by a pump piston of a high-pressure fuel pump, which piston is driven in a reciprocating motion by a cam. A control valve actuated by a piezoelectric actuator is provided, which is triggered by an electric control unit and by which a communication of the pressure chamber with a relief chamber is controlled. The control valve has a control valve member, upon which the actuator acts via a hydraulic coupler in order to move it between an opened position and a closed position. When the control valve member is in its closed position, the pressure chamber is disconnected from the relief chamber, and high pressure for a fuel injection can build up in it. The instant the closing position of the control valve member is reached is thus of great significance for controlling the fuel injection. Since the control valve member is disconnected from the coupler by the actuator, however, no information about this instant is available. Furthermore, proper function of the control valve also requires complete filling of the coupler.

SUMMARY AND ADVANTAGES OF THE INVENTION

The fuel injection system of the invention has the advantage over the prior art that the function of the control valve can be monitored. During the charging phase of the piezoelectric actuator, a pressure builds up in the hydraulic coupler that also has a feedback effect on the actuator after the charging process has been completed, and in the actuator, once the voltage supply has been cut off, this pressure generates a piezoelectric voltage that is characteristic for the pressure conditions in the coupler and accordingly also for the conversion of the trigger voltage into the stroke of the control valve member. Thus the voltage between the electrical terminals of the piezoelectric actuator can be used, without requiring a further sensor, as a measured parameter for the valve behavior.

Various advantageous features and refinements of the fuel injection system of the invention are disclosed. The measured voltage can be used to ascertain the instant when the closing position of the control valve member is reached. The course of the voltage can be monitored, for the occurrence of a minimum point in the curve course. Once the charging of the actuator has been completed, the pressure in the coupler initially drops over time, since the actuator, after the completion of the charging process, has nearly reached its complete stroke, while the control valve member at this instant is still moving towards its closing position, and the coupler is thus depressurized. However, as soon as the control valve member has reached the closing position and is moving back toward its opening position because of its recoil, a compression of the medium located in the coupler occurs, which makes itself felt in an increase in the terminal voltage. The minimum point occurring in the course of the voltage thus identifies the instant at which the control valve member has reached its closing position. Alternatively, the derivation over time of the terminal voltage can also be formed and monitored for a zero crossover. The zero crossover of the voltage signal derived over time thus likewise identifies the minimum point in the course over time of the terminal voltage and thus the attainment of the closing position by the control valve member. In a further advantageous feature, a correction value for a control parameter of the control unit is derived from the ascertained instant when the closing position of the control valve member is reached. In particular, a correction value for the triggering voltage of the actuator and/or for the instant of triggering and/or for the duration of the charging process can be furnished. The voltage can also be used to detect the fill state of the coupler, since the pressure course in the coupler is dependent on the fill state and thus likewise has feedback effects on the voltage. The test triggering provided makes it possible to monitor the function of the control valve before a fuel injection, and correction values that can be used in the ensuing fuel injection can be ascertained. The time interval between the ascertainment of the correction value and the triggering of the control valve for the fuel injection is thus very brief, and so the fuel injection can be effected with high precision.

BRIEF DESCRIPTION OF THE DRAWINGS

The foregoing and other features of the invention will become apparent from the description contained herein below, taken in conjunction with the drawings in which.

DESCRIPTION OF THE PREFERRED EMBODIMENT

Figure 1:
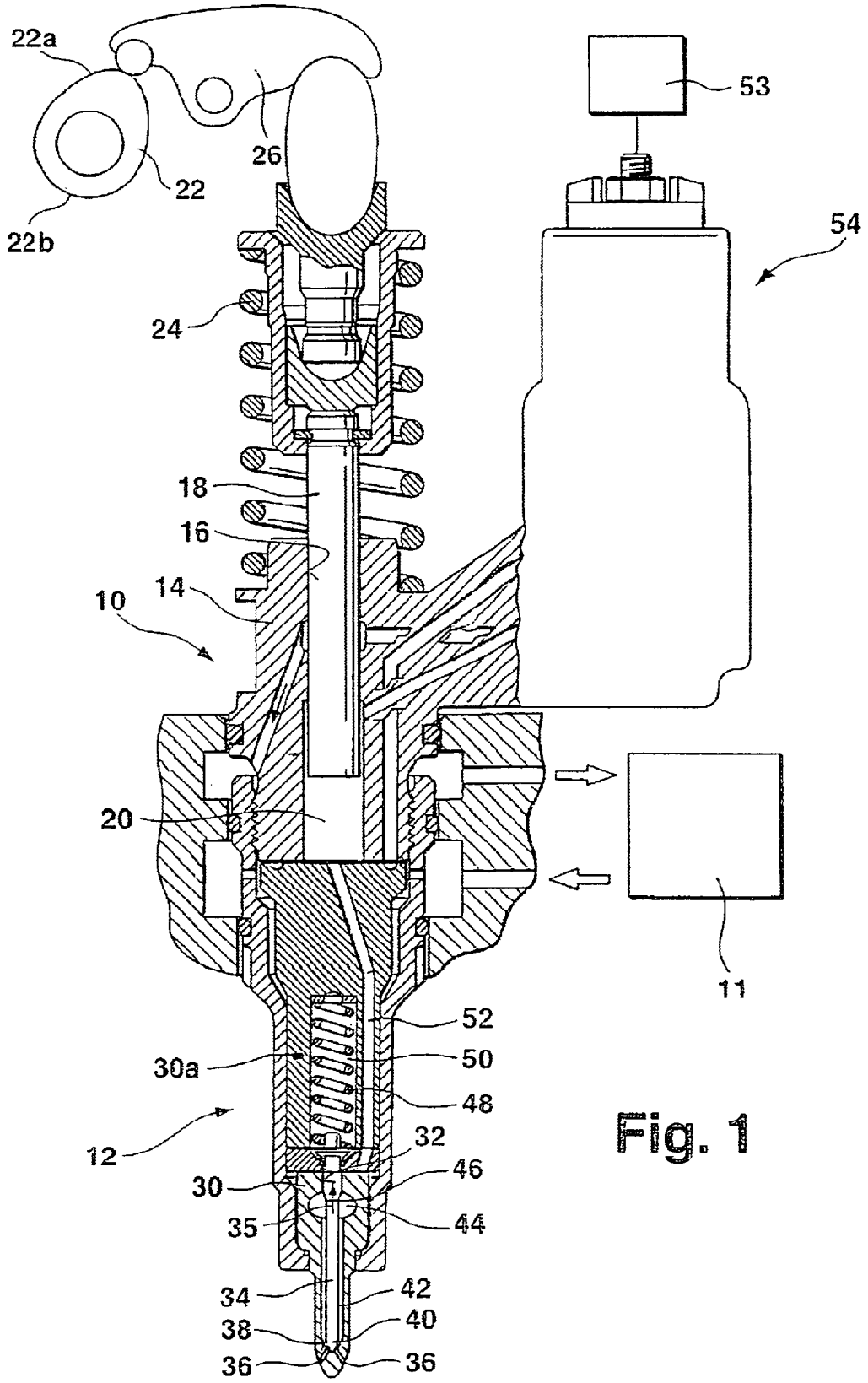
FIG. 1 shows a fuel injection system for an internal combustion engine in a schematic illustration.
Figure 2:
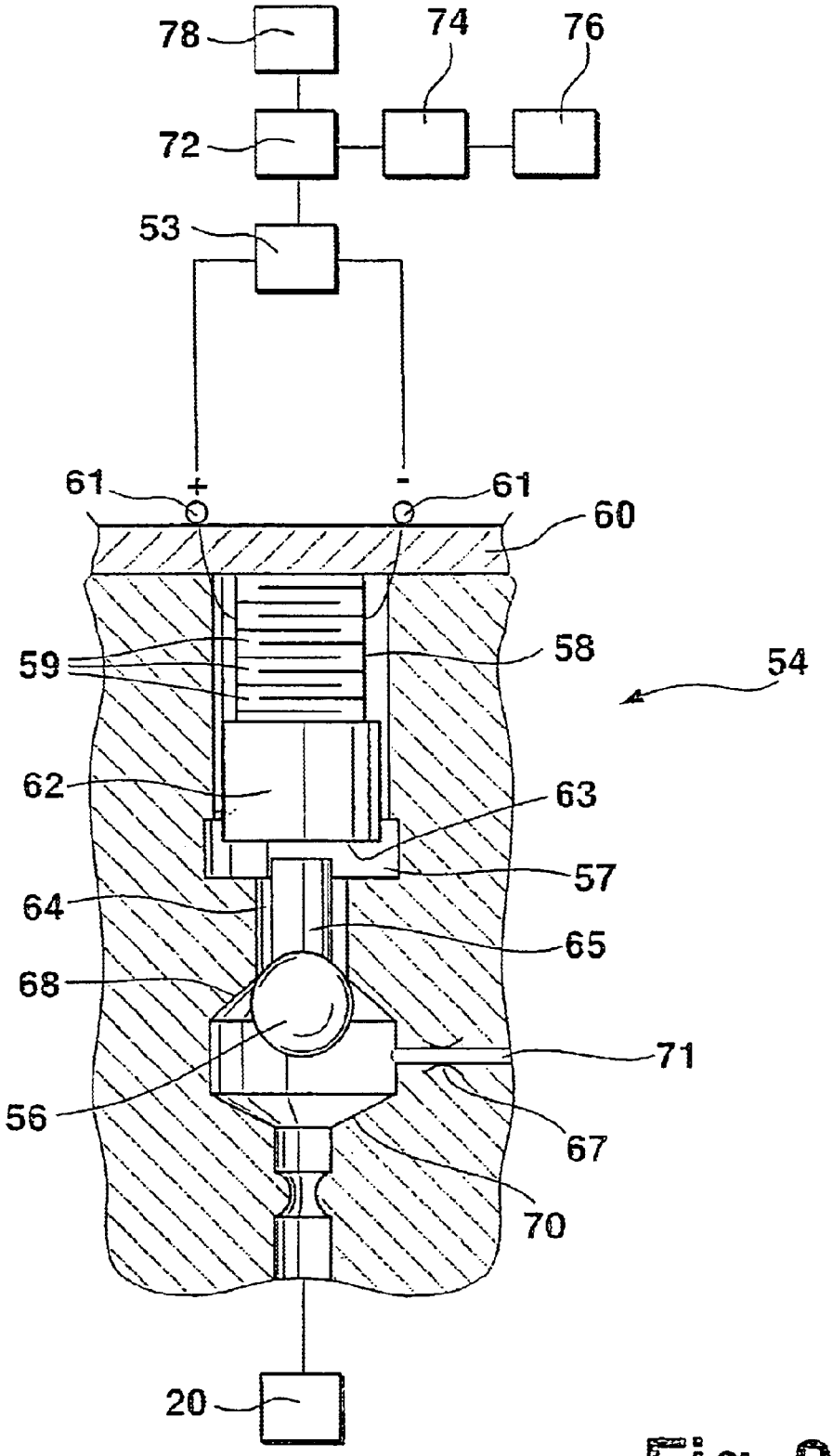
FIG. 2 shows a fuel injection valve of the fuel injection system in an enlarged illustration.

In FIGS. 1 and 2, a fuel injection system for an internal combustion engine, for instance of a motor vehicle, is shown. The fuel injection system has a high-pressure fuel pump 10 and a fuel injection valve 12 communicating with it.

In the exemplary embodiment shown, the high-pressure fuel pump 10 and the fuel injection valve 12 communicate directly with one another and form a so-called unit injector. Alternatively, however, it can also be provided that the high-pressure fuel pump 10 is located at a distance from the fuel injection valve 12 and communicates with it via a line. For each cylinder of the engine, one fuel injection system with one high-pressure fuel pump 10 and one fuel injection valve 12 is provided.

The high-pressure fuel pump 10 has a pump body 14, in which a pump piston 18 is guided displaceably in a cylinder bore 16, and this pump piston defines a pump work chamber 20 in the cylinder bore 16. The pump piston is driven in a reciprocating motion by a camshaft of the engine via a cam 22, counter to a restoring spring 24. A tilt lever 26 can be disposed as a transmission element between the cam 22 and the pump piston 18. The cam 22 has a raised region 22*a*, by way of which the pump piston 18 is pressed, counter to the force of the restoring spring 24, into the cylinder bore 16 as far as an inner dead center point, and a flatter region 22*b*, by way of which the pump piston 18 is forced out of the cylinder bore 16 as far as an outer dead center point by the restoring spring 24. In the reciprocating motion of the pump piston 18 into the cylinder bore 16, this piston executes a pumping stroke, in which fuel in the pump work chamber 20 is compressed. In the reciprocating motion of the pump piston 18 out of the cylinder bore 16, this piston executes an intake stroke, in which fuel is aspirated into the pump work chamber 20.

The fuel injection valve 12 has a valve body 30, which can be embodied in multiple parts, and in which an injection valve member 34 is guided in a bore 32. The valve body 30 has one and preferably a plurality of injection openings 36 in its end region toward the combustion chamber of the cylinder of the engine, and these openings are distributed over the circumference of the valve body 30. The injection valve member 34, in its end region toward the combustion chamber, has a sealing face 38, which for instance is approximately conical, and which cooperates with a valve seat 40, embodied in the end region toward the combustion chamber of the valve body 30, from which valve seat or downstream of which the injection openings 36 lead away. Between the injection valve member 34 and the bore 32, toward the valve seat 40, an annular chamber 42 is formed in the valve body 30; in its end region remote from the valve seat 40, this chamber changes over, as a result of a radial enlargement of the bore 32, into a pressure chamber 44 surrounding the injection valve member 34. At the level of the pressure chamber 44, as a result of a cross-sectional change, the injection valve member 34 has a pressure shoulder 46, by way of which the pressure prevailing in the pressure chamber 44 generates a force on the injection valve member 34 away from the valve seat 40. The end of the injection valve member 34 remote from the combustion chamber is engaged by a prestressed closing spring 48, by which the injection valve member 34 is pressed toward the valve seat 40. The closing spring 48 is disposed in a spring chamber 50 of a spring holder 30a that forms part of the valve body 30 and that adjoins the bore 32.

The pressure chamber 44 of the fuel injection valve 12 communicates with the pump work chamber 20 of the high-pressure fuel pump 10 via a conduit 52. When the pressure prevailing in the pressure chamber 44 generates a greater force, via the pressure shoulder 46, on the injection valve member 34 than the force generated by the closing spring 48, the injection valve member 34 lifts in its opening direction 35 with its sealing face 38 from the valve seat 40 and uncovers the injection openings 36, through which fuel is injected into the combustion chamber. When the pressure prevailing in the pressure chamber 44 and exerted via the pressure shoulder 46 on the injection valve member 34 generates a lesser force than the force generated by the closing spring 48, the injection valve member 34 moves with its sealing face 38 toward the valve seat 40 counter to its opening direction 35, and upon contact with the valve seat 40 closes the injection openings 36, so that no fuel is injected into the combustion chamber.

For controlling the fuel injection, an electrically triggered control valve 54 is provided, by which a communication of the pump work chamber 20 with a relief chamber is controlled. The fuel tank 11 of the motor vehicle, for instance, or some other region in which a slight pressure prevails can serve as the relief chamber. The control valve 54 has a control valve member 56, which is actuated via a hydraulic coupler 57 by a piezoelectric actuator 58. The actuator 58 is supplied with an electrical voltage by an electronic control unit 53. The actuator 59 has a number of series-connected piezoelectric elements 59. The control valve 54 is disposed on the pump body 14, for example. The actuator is connected nonpositively on the one hand to a housing wall 60, through which electrical terminals 61 of the actuator 58 are passed, and on the other to an adjusting piston 62. The adjusting piston 62, with its end face 63 remote from the actuator 58, closes off the hydraulic coupler 57. The hydraulic coupler 57 in turn acts on an adjusting piston 65, guided in a connecting conduit 64, on the end of which remote from the coupler 57 the control valve member 56 is disposed. It can be provided that the control valve member 56 cooperates with two valve seats, which are embodied in a valve chamber 66, in which the control valve member 56 is disposed. The control valve member 56, in a first end position that corresponds to a voltageless position of repose of the actuator 58, rests on a first valve seat 68 in the valve chamber 66. In a second end position, which corresponds to maximum triggering of the actuator 58 and which is a closing position of the control valve member 56, the control valve member 56 rests on and closes a second valve seat 70 in the valve chamber 66 and closes it. It can also be provided that the control valve 54 is embodied as a bidirectional valve; then when the control valve member 56 is in contact with one of the two valve seats 68, 70, it is closed, while it is opened only when it is in an intermediate position between the two valve seats 68, 70.

A communication 71 with the relief chamber discharges into the valve chamber 66 between the two valve seats 68, 70. Via the second valve seat 70, the valve chamber 66 has a communication with the pump work chamber 20. When the control valve member 56 in its first end position is in contact with the first valve seat 68, the communication of the valve chamber 66 with the pump work chamber 20 is opened via the second valve seat 70, so that the pump work chamber 20 communicates with the relief chamber, and a high pressure cannot build up in it. A throttle restriction 67 can be provided in the communication 71 of the valve chamber 66 with the relief chamber. When the control valve member 56 is in its second end position and hence its closing position, in contact with the second valve seat 70, the communication of the valve chamber 66 with the pump work chamber 20 is closed via the second valve seat 70, so that the pump work chamber 20 is disconnected from the relief chamber, and high pressure can build up in it, corresponding to the pumping stroke of the pump piston 18. The instant when the closing position of the control valve member 56 is reached thus determines the onset of the fuel injection, and the length of time while the control valve member 56 is in its closing position determines the fuel quantity that is injected.

The actuator 58 of the control valve 54 is triggered by the control unit 53 as a function of such engine operating parameters as rpm, load, temperature, and others. For controlling the fuel injection with high precision, feedback about the onset of the fuel injection is necessary; this onset is at least approximately simultaneous with the instant when the closing position of the control valve member 56 is reached. For detecting whether the control valve member 56 has reached its closing position, after the charging process has taken place or in other words after triggering of the actuator 58 to close the control valve 54 has occurred, a voltage meter 72 which may be a component of the control unit 53 is connected to the terminals 61 of the actuator 58 for the predetermined duration of a measurement window. A diagnostic device 74 can be connected to the voltage meter 72. The measurement data can be forwarded directly, for instance in the form of an analog voltage signal, to the diagnostic device 74. Thus monitoring of the voltage between the terminals 61 of the actuator 58 takes place as a function of time. Alternatively, however, it is possible first to form the derivation over time of the voltage between the terminals 61. To that end, the voltage signals are supplied to a differentiation member 76 associated with the voltage meter 72. The differentiated signals formed there are then forwarded to the diagnostic device 74. In both alternatives, a conclusion about whether the closing position of the control valve member 56 has been reached is drawn in the diagnostic device 74 from the course over time of the voltage between the terminals 61 of the actuator 58.

For detecting the closing position of the control valve member 56, the course over time of the voltage between the terminals 61 of the actuator 58 is monitored for the occurrence of a minimum point in the curve course. Accordingly, in the evaluation of the derivation over time of the voltage by means of the differentiation member 76, the occurrence of a zero crossover is monitored. As has been found, after the completion of the charging phase of the actuator 58, the pressure in the hydraulic coupler 57 initially drops, since after the completion of the charging process, the actuator 58 has nearly reached its complete stroke, while at that instant the control valve member 56 is still moving toward its closing position, and the coupler 57 is thus depressurized. This pressure drop can be evidenced by way of monitoring the voltage between the terminals 61 of the actuator 58, the evidence being in the form of a reduction in the voltage that occurs as a function of time.

However, as soon as the control valve member 56 has reached its closing position and because of recoil is moving back in the direction of its first end position, a compression of the medium located in the coupler occurs, and this makes itself felt analogously in a rise in the voltage between the terminals 61 of the actuator 58. The minimum point occurring in the voltage course thus identifies the instant at which the control valve member 56 has reached its closing position. On the basis of the detection of the instant of closure of the control valve 54, correction values for control parameters of the control unit 53 can be obtained, which can be used for an ensuing fuel injection, and by which the precision of the fuel injection in terms of the instant of fuel injection and the fuel injection quantity can be improved.

It can be provided that the above-described monitoring of the voltage between the terminals 61 of the actuator 58 be performed during each fuel injection that occurs. The correction values obtained can then be used for controlling the next fuel injection.

Alternatively, it can be provided that the above-described monitoring of the voltage take place during a test triggering of the control valve 54 by the control unit 53 in a time interval during which no fuel injection occurs. This is especially the case during a stroke phase of the pump piston 18 in which this piston is moving out of the cylinder bore 16 toward its outer dead center point. The cam 22 is then located with its flatter region 22*b* in contact with the tilt lever 26. During this stroke phase of the pump piston 18, this pump piston does not generate an adequate pressure for a fuel injection in the pump work chamber 20 and thus in the pressure chamber 44 of the fuel injection valve 12, and so even upon closure of the control valve 54, no fuel injection occurs. The test triggering of the control valve 54 is preferably effected during a time interval during which both the filling of the pump work chamber 20 with fuel in the intake stroke of the pump piston 18 and the diversion of fuel out of the pump work chamber 20 for ending the fuel injection with the control valve 54 opened are affected only extremely slightly, if at all.

In the test triggering of the control valve 54, correction parameters can be obtained that can already be used in controlling the ensuing fuel injection. The time offset between when the correction values are obtained and when the fuel injection is controlled is only about half as long, in the test triggering of the control valve 54, as when the correction values are obtained in the fuel injection that actually ensues. The precision of control of the fuel injection can thus be still further increased substantially. In the test triggering of the control valve 54, the correction values are ascertained immediately before the triggering for the fuel injection.

Via leakage gaps, upon the motion of the adjusting piston 62 some of the medium, which is preferably fuel, located in the hydraulic coupler 57 is forced out. For an intended relationship between the trigger voltage of the actuator 58 and the injected fuel quantity, however, proper filling of the coupler 57 is required. Between injections, refilling of the coupler 57 is therefore provided via a conduit, not shown. For monitoring whether the coupler 57 has in fact been properly refilled, once again the voltage between the terminals 61 of the actuator 58 can be used. After the charging process of the actuator 58, once again the course over time of the voltage between the terminals 61 of the actuator 58 is monitored by the voltage meter 72. It has been found that after the completion of the charging process of the actuator 58, the pressure in the hydraulic coupler 57 drops still further because of outflowing medium. This pressure drop can be evidenced, in the form of a reduction in the voltage occurring as a function of time, by way of monitoring the voltage between the terminals 61 of the actuator 58. The extent of this drop in voltage over time is also dependent on the so-called boosting ratio in the coupler 57, that is, the ratio of the cross-sectional area of the adjusting piston 62 to the cross-sectional area of the adjusting piston 65, and also on the ratio between the stroke of the control valve member 56 that can be generated and the change in length of the actuator 58 that acts on the coupler 57. The reduction in the voltage furthermore depends to a particularly pronounced extent on the degree of filling in the coupler 57. When the coupler 57 is completely full, a comparatively pronounced voltage dip of approximately 50 V, for instance, can be evidenced. Conversely, with an only partly filled coupler 57 this effect is markedly less, and the voltage dip then amounts to only about 15 V, for instance.

Thus from monitoring the voltage between the terminals 61 of the actuator 58, a diagnosis is made in the diagnostic device 74, by measuring the voltage once the charging phase of the actuator 58 has taken place. After a predeterminable waiting time, for instance of about 0.25 ms, the voltage is measured again. Then the difference in the two measured values is formed and compared with a limit value. A fixed limit value can be specified, which can for instance amount to approximately 30 V. Alternatively, however, a limit value that is dependent on an operating point and is obtained from a performance graph, obtained from prior calibration and stored in a data storage module 78, can be made the basis. The waiting time can be selected such that the measurement of the voltage occurs immediately before an ensuing control intervention, namely before a further raising of the voltage.

If the ascertained difference in the voltage is greater than the limit value, then as the diagnosis, the conclusion is drawn that the coupler 57 has been completely and properly refilled, and no further provision is initiated. However, if the ascertained difference in the voltage is less than the limit value, then as the diagnosis the conclusion is that refilling of the coupler 57 is incomplete and defective. In that case, a further comparison is made between the difference in the voltages and a second limit value or minimal value. By means of this comparison, a distinction is also made in terms of the effects of the error. If the difference in the voltages is also less than a second, even lower limit value or minimal value, then a substantial error is diagnosed, one that for instance causes an immediate stoppage of the engine. Conversely, if the difference in the voltages is below the first limit value but above the second limit value, then a minor error is diagnosed, which does permit continued operation of the engine but is stored in the data storage module 78 for the sake of later diagnostic purposes.

If a minor error is ascertained in the diagnostic device 74, a set-point value for the trigger voltage of the actuator 58 is also specified, and the set-point value is selected such that despite the finding of incomplete filling of the coupling 57, the intended stroke of the control valve member 56 results after triggering. The above-described monitoring of the voltage between the terminals 61 of the actuator 58 is preferably performed during a test triggering of the control valve 54, in a phase during which no fuel injection is taking place.

The foregoing relates to preferred exemplary embodiments of the invention, it being understood that other variants and embodiments thereof are possible within the spirit and scope of the invention, the latter being defined by the appended claims.

What is claimed is:

1. A fuel injection system for an internal combustion engine, comprising a fuel injection valve (12) which has at least one injection valve member (34) by which at least one injection opening (36) is controlled, in which the injection valve member (34) is urged in an opening direction (35) counter to a closing force by the pressure prevailing in a pressure chamber (44) of the fuel injection valve (12);

a pump piston (18) of a high-pressure fuel pump (10) driven in a reciprocating motion by a cam (22) for generating the pressure prevailing in the pressure chamber (44);

a control valve (54) actuated by a piezoelectric actuator (58)

an electric control unit (53) for triggering the piezoelectric actuator (58) whereby at least indirectly, a communication (71) of the pressure chamber (44) with a relief chamber is controlled;

the pressure chamber (44) being disconnected from the relief chamber when the control valve (54) is closed;

the control valve (54) having a control valve member (56) coupled with the actuator (58) via a hydraulic coupler (57), the actuator (58), after a charging phase, communicating with an associated voltage meter (72); and the voltage between the electrical terminals (61) of the actuator (58) being monitored for detecting the function of the control valve (54).

2. The fuel injection system of claim 1, wherein the voltage between the electrical terminals (61) of the actuator (58) is used for detecting the attainment of a closing position of the control valve member (56).

3. The fuel injection system of claim 2, wherein the course over time of the voltage is monitored for the occurrence of a minimum point in the curve course.

4. The fuel injection system of claim 2, wherein the deviation over time of the voltage is formed and monitored for a zero crossover.

5. The fuel injection system of claim 2, wherein, from the ascertained instant of attainment of the closing position of the control valve member (56), a correction value for a control parameter of the control unit (53) is formed, which value is taken into account in an ensuing fuel injection.

6. The fuel injection system of claim 3, wherein, from the ascertained instant of attainment of the closing position of the control valve member (56), a correction value for a control parameter of the control unit (53) is formed, which value is taken into account in an ensuing fuel injection.

7. The fuel injection system of claim 4, wherein, from the ascertained instant of attainment of the closing position of the control valve member (56), a correction value for a control parameter of the control unit (53) is formed, which value is taken into account in an ensuing fuel injection.

8. The fuel injection system of claim 1, wherein the voltage between the electrical terminals (61) of the actuator (58) is used for detecting the fill state of the coupler (57).

9. The fuel injection system of claim 2, wherein the voltage between the electrical terminals (61) of the actuator (58) is used for detecting the fill state of the coupler (57).

10. The fuel injection system of claim 3, wherein the voltage between the electrical terminals (61) of the actuator (58) is used for detecting the fill state of the coupler (57).

11. The fuel injection system of claim 8, wherein a difference between a voltage measured immediately after the termination of the charging phase of the actuator (58) and a voltage measured after a predeterminable waiting time has elapsed is compared with a limit value.

12. The fuel injection system of claim 9, wherein a difference between a voltage measured immediately after the termination of the charging phase of the actuator (58) and a voltage measured after a predeterminable waiting time has elapsed is compared with a limit value.

13. The fuel injection system of claim 10, wherein a difference between a voltage measured immediately after the termination of the charging phase of the actuator (58) and a voltage measured after a predeterminable waiting time has elapsed is compared with a limit value.

14. The fuel injection system of claim 1, wherein the voltage between the electrical terminals (61) of the actuator (58) is monitored for detecting the function of the control valve (54) during a test triggering of the control valve (54), during which no fuel injection occurs.

15. The fuel injection system of claim 2, wherein the voltage between the electrical terminals (61) of the actuator (58) is monitored for detecting the function of the control valve (54) during a test triggering of the control valve (54), during which no fuel injection occurs.

16. The fuel injection system of claim 3, wherein the voltage between the electrical terminals (61) of the actuator (58) is monitored for detecting the function of the control valve (54) during a test triggering of the control valve (54), during which no fuel injection occurs.

17. The fuel injection system of claim 14, wherein test triggering of the control valve (54) occurs in a phase of reciprocation of the pump piston (18) during which this pump piston does not generate any pressure in the pressure chamber (44) of the fuel injection valve (12) that is sufficient to open the injection valve member (34).

18. The fuel injection system of claim 2, wherein test triggering of the control valve (54) occurs in a phase of reciprocation of the pump piston (18) during which this pump piston does not generate any pressure in the pressure chamber (44) of the fuel injection valve (12) that is sufficient to open the injection valve member (34).

19. The fuel injection system of claim 3, wherein test triggering of the control valve (54) occurs in a phase of reciprocation of the pump piston (18) during which this pump piston does not generate any pressure in the pressure chamber (44) of the fuel injection valve (12) that is sufficient to open the injection valve member (34).

20. The fuel injection system of claim 1, wherein for each fuel injection valve (12), the fuel injection system has its own high-pressure fuel pump (10), with a pump piston (18) that is driven by a cam (22).

* * * * *